US008434284B1

(12) United States Patent
Plummer et al.

(10) Patent No.: US 8,434,284 B1
(45) Date of Patent: May 7, 2013

(54) METHOD FOR FORMING A DOOR ASSEMBLY OR A WINDOW ASSEMBLY WITH A DUAL SUPPORT CONNECTOR

(75) Inventors: John B. Plummer, Houston, TX (US); Joseph Gene Denley, Cypress, TX (US)

(73) Assignee: GlassCraft Door Company, Houston, TX (US)

( * ) Notice: Subject to any disclaimer, the term of this patent is extended or adjusted under 35 U.S.C. 154(b) by 0 days.

(21) Appl. No.: 13/533,789

(22) Filed: Jun. 26, 2012

(51) Int. Cl.
*E04G 23/00* (2006.01)

(52) U.S. Cl.
USPC ..... 52/745.16

(58) Field of Classification Search ..... 52/745.15, 52/745.16, 208, 204.62, 204.72, 455, 205, 52/456, 204.61, 656.4
See application file for complete search history.

(56) References Cited

U.S. PATENT DOCUMENTS 3,641,721 A * 2/1972 Martin ..... 52/212
3,750,358 A * 8/1973 Lewkowitz ..... 52/204.597
3,760,543 A * 9/1973 McAllister ..... 52/204.591
3,903,669 A * 9/1975 Pease et al. ..... 52/455
4,021,967 A * 5/1977 Mulder et al. ..... 49/171
4,246,731 A * 1/1981 Miro ..... 52/204.53
4,720,951 A * 1/1988 Thorn et al. ..... 52/208
4,735,025 A * 4/1988 Day ..... 52/217
4,897,975 A * 2/1990 Artwick et al. ..... 52/208
4,920,718 A * 5/1990 Artwick et al. ..... 52/476
4,947,597 A * 8/1990 Simpson ..... 52/208
5,018,330 A * 5/1991 Lewkowitz ..... 52/455
5,133,168 A * 7/1992 Neilly et al. ..... 52/204.5
5,249,403 A * 10/1993 Neilly et al. ..... 52/204.5
5,365,707 A * 11/1994 Jones et al. ..... 52/211
5,570,548 A * 11/1996 Hopper ..... 52/204.5
5,577,355 A * 11/1996 Leonelli ..... 52/204.62
5,634,508 A * 6/1997 Herbst ..... 160/371
5,636,484 A * 6/1997 DeBlock ..... 52/204.5
5,644,881 A * 7/1997 Neilly ..... 52/455
5,749,184 A * 5/1998 McKann ..... 52/204.1
5,765,325 A * 6/1998 DeBlock ..... 52/204.5
5,894,706 A * 4/1999 Herbst ..... 52/782.1
6,151,849 A * 11/2000 Twigg et al. ..... 52/208
6,272,801 B1 * 8/2001 Suh ..... 52/211
6,318,037 B1 * 11/2001 Hansen ..... 52/208
6,546,682 B1 * 4/2003 DeBlock et al. ..... 52/204.72
6,553,735 B1 * 4/2003 Wang Chen ..... 52/455
6,574,935 B2 * 6/2003 Wang Chen ..... 52/455
6,672,021 B2 * 1/2004 Kusano et al. ..... 52/211
6,694,701 B2 * 2/2004 Wang et al. ..... 52/783.1
6,715,245 B2 * 4/2004 Lewkowitz ..... 52/208
6,763,647 B2 * 7/2004 Yeany ..... 52/786.1
6,925,767 B2 * 8/2005 Krochmal et al. ..... 52/455
6,931,810 B2 * 8/2005 Beaudoin et al. ..... 52/455

(Continued)

*Primary Examiner* — William Gilbert
*Assistant Examiner* — James Ference
(74) *Attorney, Agent, or Firm* — Buskop Law Group, PC; Wendy Buskop

(57) ABSTRACT

Methods for installing a glass panel, including an insulated glass panel, a security glass panel, or a decorative leaded glass panel, to an opening in a door or a window without creating holes in the door or glass panel using a dual support connector with connector body, connector hole extending through the connector body, a glass flange integral with the connector body for overlaying an edge portion of the glass panel; an structural panel flange integral with the connector body, extending at a right angle to the connector hole away from the connector body parallel to while opposite the glass panel flange for overlaying an edge portion of the structural panel while in a plane apart from a plane of the glass flange.

12 Claims, 11 Drawing Sheets

U.S. PATENT DOCUMENTS

| | | | | |
|---|---|---|---|---|
| 7,386,959 | B2 * | 6/2008 | Ouellette | 52/204.53 |
| 7,448,174 | B2 * | 11/2008 | Krochmal et al. | 52/204.54 |
| D613,878 | S * | 4/2010 | Walsh et al. | D25/60 |
| 7,721,501 | B2 * | 5/2010 | Lynch et al. | 52/456 |
| D625,838 | S * | 10/2010 | Walsh et al. | D25/60 |
| 7,950,193 | B1 * | 5/2011 | Plummer et al. | 52/204.61 |
| 8,061,036 | B1 * | 11/2011 | Plummer et al. | 29/897.32 |
| 8,091,282 | B2 * | 1/2012 | Speyer et al. | 49/317 |
| 8,109,037 | B2 * | 2/2012 | Speyer et al. | 49/318 |
| 8,141,833 | B1 * | 3/2012 | Plummer et al. | 248/229.1 |
| 8,146,304 | B1 * | 4/2012 | Plummer et al. | 52/204.61 |
| 8,171,643 | B1 * | 5/2012 | Plummer et al. | 29/897.32 |
| 8,171,644 | B1 * | 5/2012 | Plummer et al. | 29/897.32 |
| 8,297,007 | B2 * | 10/2012 | Sayer | 52/171.1 |
| 8,336,258 | B2 * | 12/2012 | Speyer et al. | 49/318 |
| 8,359,796 | B1 * | 1/2013 | Plummer et al. | 52/204.61 |
| 8,365,480 | B1 * | 2/2013 | Plummer et al. | 52/208 |
| 2003/0000163 | A1 * | 1/2003 | Lamanna | 52/204.62 |
| 2003/0041539 | A1 * | 3/2003 | Bernacki et al. | 52/204.54 |
| 2003/0056442 | A1 * | 3/2003 | Gerard | 49/504 |
| 2004/0144046 | A1 * | 7/2004 | Wang et al. | 52/204.1 |
| 2007/0193140 | A1 * | 8/2007 | Carnick et al. | 52/208 |
| 2008/0245003 | A1 * | 10/2008 | Kon et al. | 52/208 |
| 2009/0090062 | A1 * | 4/2009 | Pandorf | 49/50 |
| 2010/0064625 | A1 * | 3/2010 | Charlton et al. | 52/656.4 |
| 2010/0229500 | A1 * | 9/2010 | Lynch et al. | 52/784.13 |

* cited by examiner

FIGURE 10A
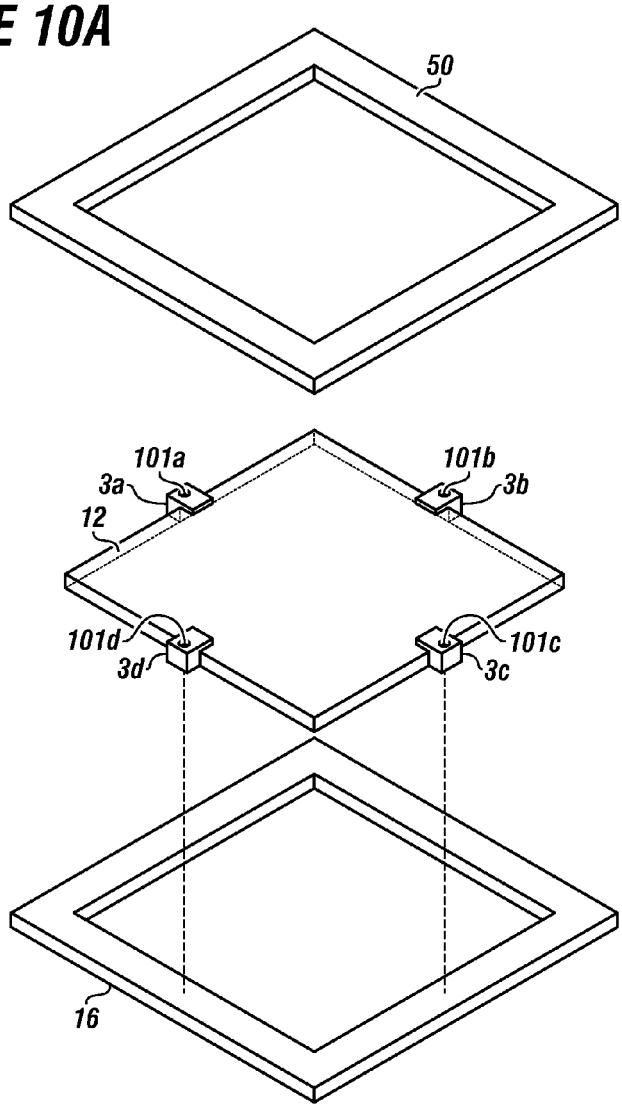
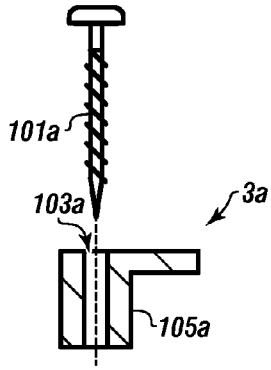
FIGURE 10B

FIGURE 11

| | |
|---|---|
| SEPARATING AN INTERIOR FRAME FROM A GLASS PANEL CONNECTED TO AN EXTERIOR FRAME WITH A PLURALITY OF SHIPPING CLIPS | 200 |
| INSTALLING A SEAL MEANS IN A GROOVE OF THE EXTERIOR FRAME WHICH WILL OVERLAY STRUCTURAL PORTIONS OF THE DOOR OR WINDOW | 201 |
| PLACING THE GLASS PANEL AFFIXED TO THE EXTERIOR FRAME WITH THE SHIPPING CLIPS STILL ATTACHED AND THE ADDITIONAL SEAL MEANS IN THE GROOVE OF THE EXTERIOR FRAME INTO AN OPENING OF A DOOR | 202 |
| PLACING A PLURALITY OF DUAL SUPPORT CONNECTORS BETWEEN THE GLASS PANEL AND THE STRUCTURAL PANEL OF THE DOOR | 203 |
| ATTACHING EACH OF THE PLURALITY OF DUAL SUPPORT CONNECTORS TO THE EXTERIOR PANEL USING A FASTENER FOR EACH DUAL SUPPORT CONNECTOR, WHILE THE GLASS PANEL IS IN THE DOOR OPENING HELD BY THE SHIPPING FASTENERS | 204 |
| PLACING FASTENING MEANS AROUND AN INSIDE SURFACE OF THE INTERIOR FRAME WHICH WOULD POSITION OVER THE CONNECTORS | 205 |
| PLACING THE INTERIOR FRAME WITH THE FASTENING MEANS OVER THE EDGES OF THE OPENING AND OVER THE EDGES OF THE GLASS PANEL, EFFECTIVELY JOINING THE INTERIOR FRAME TO THE GLASS PANEL AND TO THE STRUCTURAL PANEL WITHOUT JOINING WITH THE DUAL SUPPORT CONNECTOR OR WITH THE EXTERIOR FRAME | 206 |

FIGURE 12

| | |
|---|---|
| PLACING THE EXTERIOR FRAME ON A SURFACE WITH THE DECORATIVE FACE ON THE SURFACE AND SEAL GROOVES FACING AWAY FROM THE SURFACE | 300 |
| PLACING SEAL MEANS IN EACH OF THE SEAL GROOVES | 302 |
| PLACING A DOOR ON A SURFACE WITH THE INTERIOR SIDE DOWN | 304 |
| INSTALLING THE EXTERIOR FRAME WITH SEAL MEANS OVER THE STRUCTURAL PORTIONS OF THE DOOR SURROUNDING THE OPENING, CREATING A SEAL BETWEEN THE EXTERIOR FRAME AND THE STRUCTURAL PORTIONS OF THE DOOR | 306 |
| TURNING THE DOOR OVER WITH EXTERIOR FRAME SEALED ON THE DOOR AND PLACING A GLASS PANEL WITH EACH EDGE OF THE GLASS PANEL COVERING OVER THE OTHER SEAL MEANS OF THE EXTERIOR FRAME | 308 |
| PLACING A PLURALITY OF DUAL SUPPORT CONNECTORS BETWEEN THE GLASS PANEL AND THE STRUCTURAL PORTION OF THE DOOR CONNECTING THE GLASS FLANGE OF THE CONNECTOR TO A SIDE OF THE GLASS PANEL AND THE DOOR FLANGE OF THE CONNECTOR TO A STRUCTURAL PORTION OF THE DOOR | 310 |
| INSTALLING A FASTENER THROUGH EACH CONNECTOR BODY TO SECURE THE CONNECTOR SUPPORTING THE GLASS PANEL TO THE EXTERIOR FRAME | 312 |
| INSTALLING FASTENING MEANS OVER THE EDGES OF THE GLASS PANEL AND THE EDGES OF THE STRUCTURAL PANEL OF THE DOOR ON SIDES OF THE GLASS PANEL AND THE STRUCTURAL PANEL OF THE DOOR WHICH ARE NOT ENGAGING THE EXTERIOR FRAME, ON THE INTERIOR SIDE OF THE DOOR | 314 |
| PLACING AN INTERIOR FRAME OVER THE FASTENING MEANS CONNECTING REMOVABLY, THE INTERIOR FRAME TO THE GLASS PANEL AND TO THE STRUCTURAL PORTIONS OF THE DOOR COVERING THE PLURALITY OF DUAL SUPPORT CONNECTORS | 316 |

METHOD FOR FORMING A DOOR ASSEMBLY OR A WINDOW ASSEMBLY WITH A DUAL SUPPORT CONNECTOR

FIELD

The present embodiments generally relate to a method for forming a window or door assembly in a factory or in the field, using a plurality of dual support connectors, a glass panel, an exterior frame, and a fastener, for engaging only the dual support connector, the exterior frame, and an interior frame simultaneously.

BACKGROUND

A need exists for a method for installing in the field, glass into a door opening wherein the connectors for holding the glass to the door do not create holes in the door, window or glass panel, and the connectors are concealed from view by a user of the door.

A need exists for a method to install glass in a door opening in the field that is quick to install, easy to use, and requires no training.

A need exists for a method to install glass into existing doors and existing windows for better insulation, to save on the use of fossil fuels and associated energy costs without the need for advanced training.

A need exists for a method to install glass and security grill combinations into existing door openings and existing window openings in locations with increased crime rates to provide greater levels of safety in the home for children and senior citizens.

A need exists for a method to install glass in a door assembly using a dual support connector that is lightweight, rust resistant, and hidden within the door, without forming holes in the existing doors or windows.

The present embodiments meet these needs.

BRIEF DESCRIPTION OF THE DRAWINGS

The detailed description will be better understood in conjunction with the accompanying drawings as follows:

FIG. 10A depicts a kit created to retrofit a glass panel into a door to form the door assembly which can be used in the method.

FIG. 10B depicts an isometric view of a shipping clip and a shipping fastener usable with the kit of FIG. 10A.

FIG. 11 depicts a sequence of steps to install a glass panel in a door installed at a facility according to the method.

FIG. 12 depicts a sequence of steps to create a door assembly in a factory according to the method.

The present embodiments are detailed below with reference to the listed Figures.

DETAILED DESCRIPTION OF THE EMBODIMENTS

Before explaining the present method in detail, it is to be understood that the method is not limited to the particular embodiments and that they can be practiced or carried out in various ways.

The method can be used for creating a door light for a door not yet installed at a facility.

The method can be used for installing a replacement glass panel on a preexisting door installed at a facility, such as a door with a broken door light.

This method can be used to improve the insulation qualities of a door, by allowing a consumer to easily replace glass in a Craftsman style door or a non-Craftsman style door with insulated glass, if both types exist in the facility without the need for special tools other than a screwdriver and without the need for special training.

In embodiments, the methods can be implemented on a fiberglass door, a steel door, or a composite door.

The method allows the glass of a door to be easily replaced with high security glass or opaque panels that are burglary resistant without the need for special tools.

The method allows manufactures to have lower cost door assemblies which do not require perfect 90 degree angles and may have minor alignment issues, while still creating a useful door that can be beautiful with a door light.

The method allows a door assembly to be manufactured at a lower cost since additional labor is not required to form edge flanges on the frames of the door, and the frame usable in the door can be molded materials. By reducing these costs, the manufacturing of doors can remain in the United States, helping the American economy.

The method allows frames around the glass panels to be easily aligned in the opening of the door, even if the edges are not perfectly parallel to each other.

The method allows mounting of glass in a door or in a window without any visible mounting holes formed in the door itself or in the glass, for hole free mounting to the door, allowing easy replacement, such as for different businesses which would like their name etched on their doors, then the business moves, and a new name would be usable on the glass, the method allows for easy replacement of the glass.

The method will help the American economy because the consumer will be able to fix door lights in old doors, such as 100 year old doors, wherein the opening edges of the door are out of alignment, without requiring the customer to buy a new door or make a significant time investment in repairs.

Figure 1:
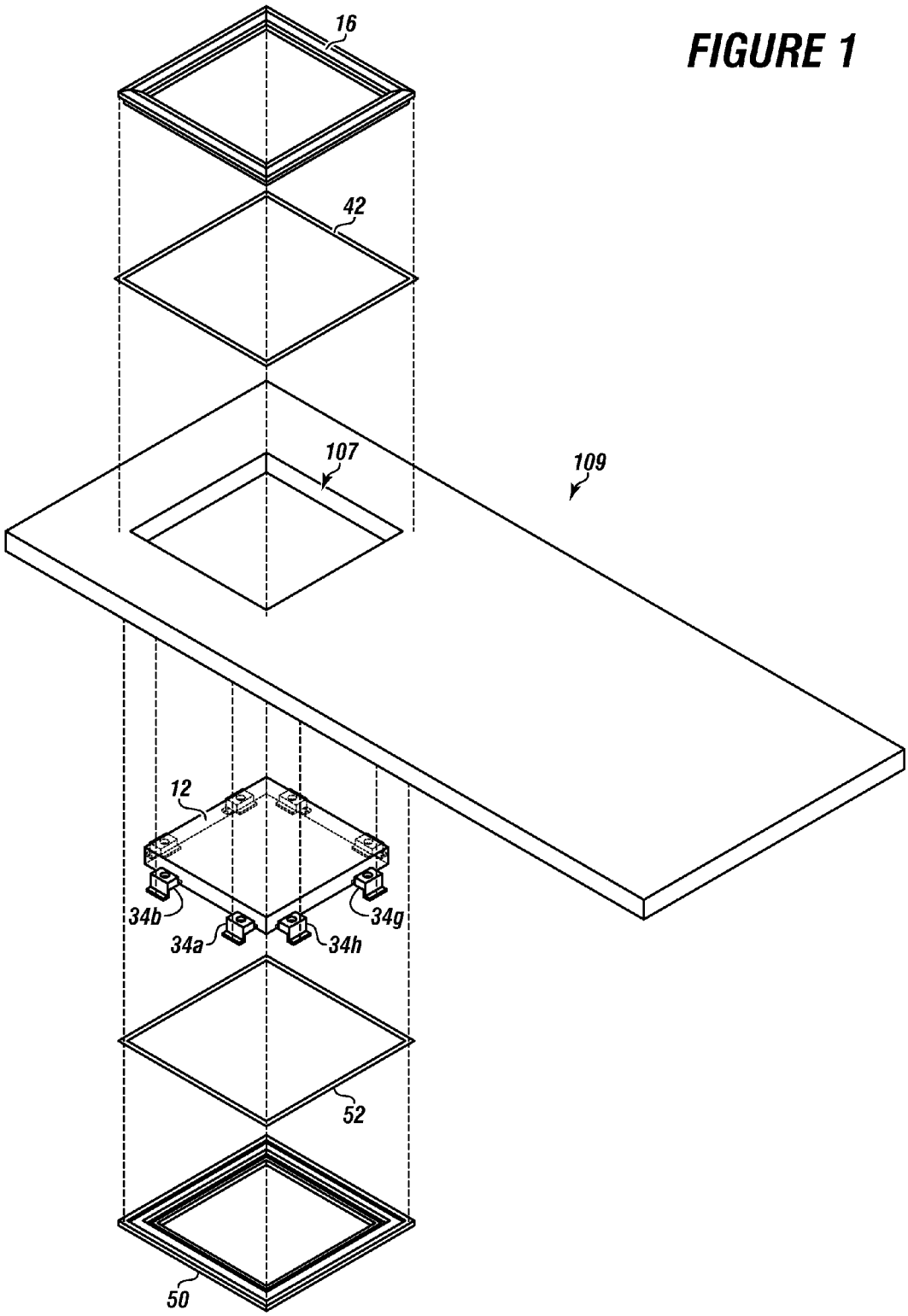
FIG. 1 depicts an assembly schematic of a door assembly using a dual support connector assembly which can be formed using the method.

Turning now to the Figures, FIG. 1 depicts an assembly schematic of a door assembly formed using a dual support connector assembly usable with the method.

A door 109 can have an opening 107. An exterior frame 16 can be disposed about the opening 107.

A first seal 42 can be disposed on the exterior frame 16. The seals can be a gasket, a curable silicone sealant, a cross linked elastomer, a resin, an adhesion promoter, a natural rubber, a synthetic rubber, or combinations thereof.

A glass panel 12 can be disposed between the first seal 42 and tape 52. The glass panel 12 can be an insulated glass assembly; a single glass pane; a leaded glass insert; a stained glass insert; a security panel, such as tempered or laminated glass; or combinations of these panels.

Dual support connectors 34*a*-34*h* can be positioned over an edge of the glass panel. The dual support connectors 34*a*-34*h* can connect with the glass panel 12 and the exterior frame 16.

The interior frame 50 can be disposed about the opening 107 on a side of the door 109 opposite the exterior frame 16. For example, the interior frame 50 can be located on the side of the door 109 that faces the interior of a house when the door is shut, and the exterior frame 16 can be disposed on the side of the door 109 that faces the outside of a house when the door is shut. The interior frame 50 can be a frame or another device configured to cover all of the plurality of installed connectors and secure to the door 109 and the glass panel 12. The interior frame 50 can be similar to the exterior frame 16 in shape and appearance.

The interior frame 50 and the exterior frame 16 can be made from any structural material. Illustrative materials can include wood; metals; plastics; recycled materials, such as recycle plastic milk bottles or recycled milk carton liners; laminated materials; composite materials, such as polyvinyl chloride and sawdust composites; or combinations thereof. The interior frame 50 and the exterior frame 16 can be embossed with a decorative wood grain into the decorative face of the frame.

Figure 2:
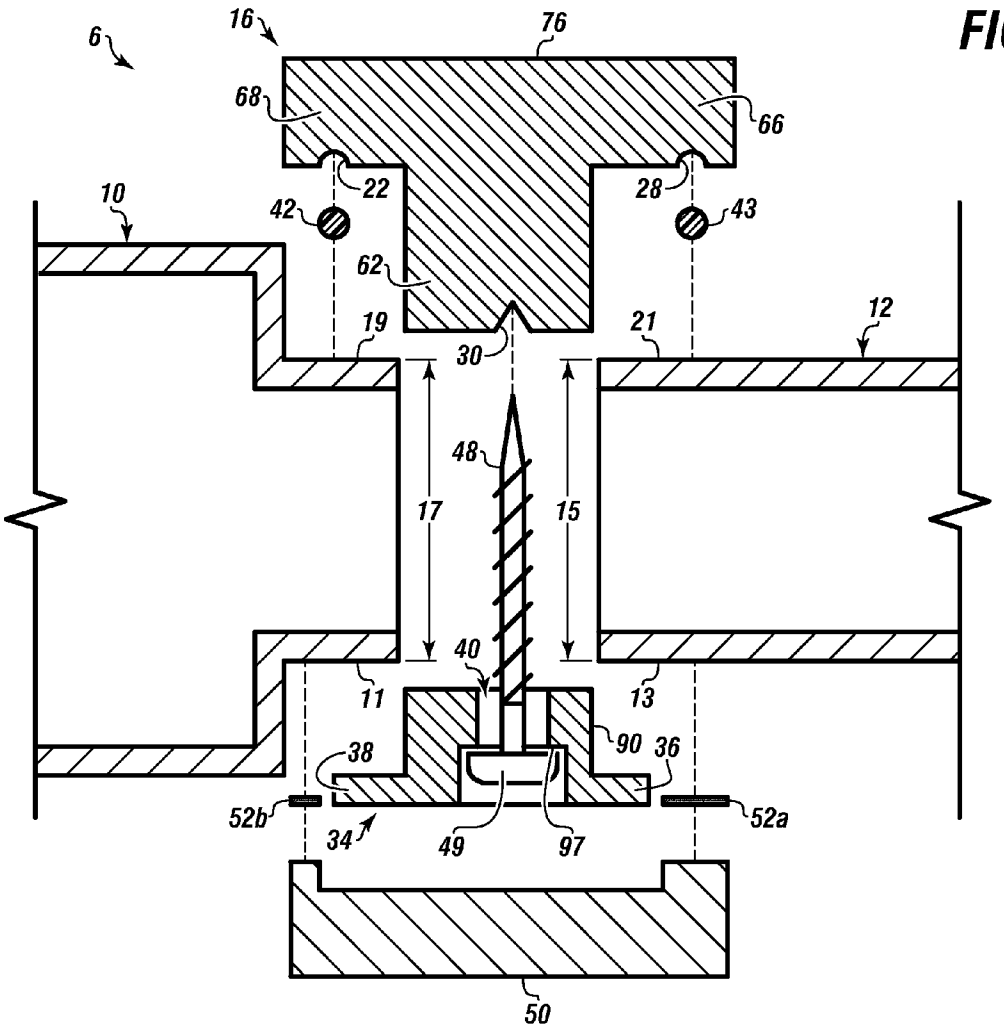
FIG. 2 depicts a detailed exploded view of the dual support connector assembly usable in the method.
Figure 3:
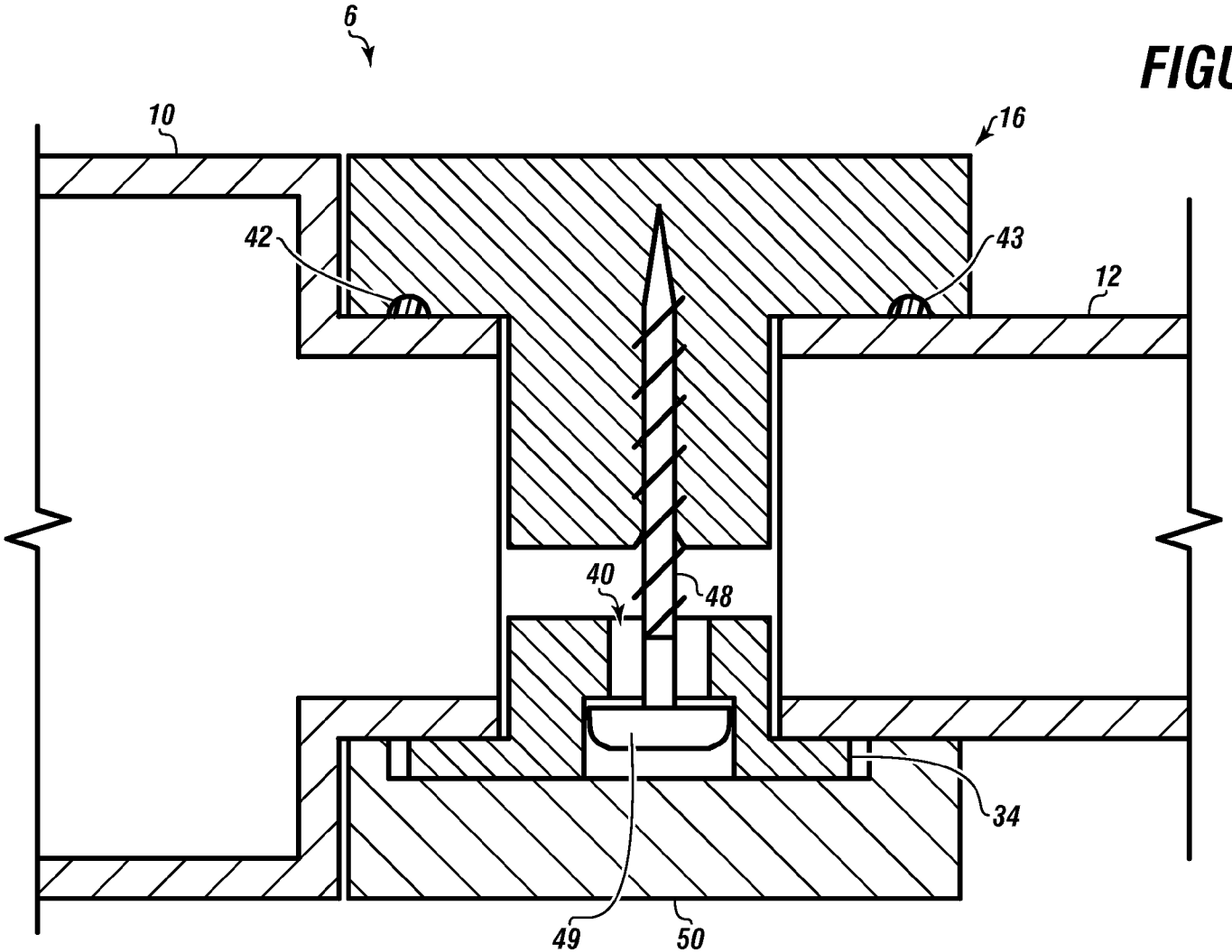
FIG. 3 depicts a detailed side view of the dual support connector assembly in an assembled configuration with the two frames and the glass connected to the support panels of a door for use in the method.

FIG. 2 depicts a detailed exploded view of the dual support connector assembly for a Craftsman style door, while FIG. 3 depicts a detailed side view of the dual support connector assembly in an assembled configuration for the same style of door of use with the method.

Referring to FIGS. 2 and 3, the dual support connector assembly 6 can include the dual support connector 34. The dual support connector 34 can be used with any door. For example, the dual support connector 34 can be used with a Craftsman style door, a wood door, a Craftsman style fiberglass door, or the like. The dual support connector 34 can be disposed at least partially between the glass panel 12 and a structural panel 10.

The glass panel 12 can have a glass panel thickness 15, and the structural panel 10 has a structural panel thickness 17. The glass panel thickness 15 and the structural panel thickness 17 can be substantially similar.

The dual support connector 34 can have a connector body 90. The connector body 90 can be generally rectangular in shape.

A connector hole 40 can extend through the connector body 90. The connector hole 40 can have a connector stop 97 disposed therein for stopping a head 49 of a fastener 48 from passing through the connector body 90.

A door flange 38 can be integral with the connector body 90. The door flange 38 can extend at a right angle to the connector hole 40 away from the connector body 90 for overlaying a panel edge portion 11 of the structural panel 10. The structural panel can be a portion of the door. For example, the structural portion for a door would be the portion of the door surrounding the opening into which the glass panel 12 is affixed.

A glass flange 36 can be integral with the connector body 90 and can extend at a right angle to the connector hole 40 away from the connector body 90. The glass flange 36 can overlay a glass edge portion 13 of the glass panel 12.

The door flange 38 and the glass flange 36 can have a thickness from about 0.5 mm to about 6 mm.

The interior frame 50 can cover all the connectors simultaneously while connecting to the panel edge portion 11 and the glass edge portion 13 with fastening means 52*a* and 52*b*. The interior frame 50 can be positioned over the fastener 48 and dual support connector 34. The interior frame 50 can be slightly wider than the dual support connector 34.

First fastening means 52*a* can be used to connect the interior frame 50 to the glass edge portion 13, and a second fastening means 52*b* can be used to connect the interior frame 50 to the panel edge portion 11. The fastening means can be an adhesive, double sided tape, or the like.

The exterior frame 16 can have an exterior frame body portion 62. The exterior frame body portion 62 can have a lower portion disposed between the glass panel 12 and the structural panel 10.

An alignment groove 30 can be located on the exterior frame body portion 62. The alignment groove 30 can be on the lower portion of the exterior frame body portion 62.

The fastener 48 holds the dual support connector 34 to the glass panel 12 by engaging with the alignment groove 30. The alignment groove 30 and the dual support connector 34 can be spaced apart, allowing for size variance between the glass panel and the structural portion of the door.

The fastener 48 can be a screw, nail, or a bolt. In a headless version of the fastener, the fastener can be an epoxy, a flexible adhesive, or combinations thereof. A portion of the fastener 48 can be configured to engage the connector stop 97, preventing the fastener 48 from passing entirely through the connector hole 40.

A decorative face 76 can be located on the exterior frame body portion 62.

A first gasket groove 22 and a second gasket groove 28 can be formed in the exterior frame body portion 62. The gasket grooves can be any shape. For example, the gasket grooves can be substantially U-shaped channels running the length of the exterior frame body portion 62.

The exterior frame body portion 62 can include an exterior frame door flange 68 and an exterior frame glass flange 66.

The exterior frame door flange 68 and the exterior frame glass flange 66 can extend laterally outwardly from the exterior frame body portion 62.

The exterior frame door flange 68 can be configured to engage a structural edge 19 of the structural panel 10. The exterior frame glass flange 66 can be configured to engage a glass edge 21 of the glass panel 12. The first gasket groove 22 can be formed on the exterior frame door flange 68. The second gasket groove 28 can be located on the exterior frame glass flange 66.

A first seal 42 can be disposed within the first gasket groove 22. The first seal 42 can seal against the structural edge 19.

A second seal 43 can be disposed within the second gasket groove 28. The second seal 43 can seal against the glass edge 21.

The seals can be gaskets or another sealing device. Illustrative seals can include flexible, deformable gaskets; curable silicone sealants; a cross linked elastomer; resins; adhesion promoters; a natural or synthetic rubber; or combinations of these components. The seals can be any material capable of forming a seal.

In embodiments, the dual support connector assembly can have an antistatic coating disposed on the connector, such as rubber, to reduce shocks or static build up which can affect security systems on doors which are electronic.

Figure 4A:
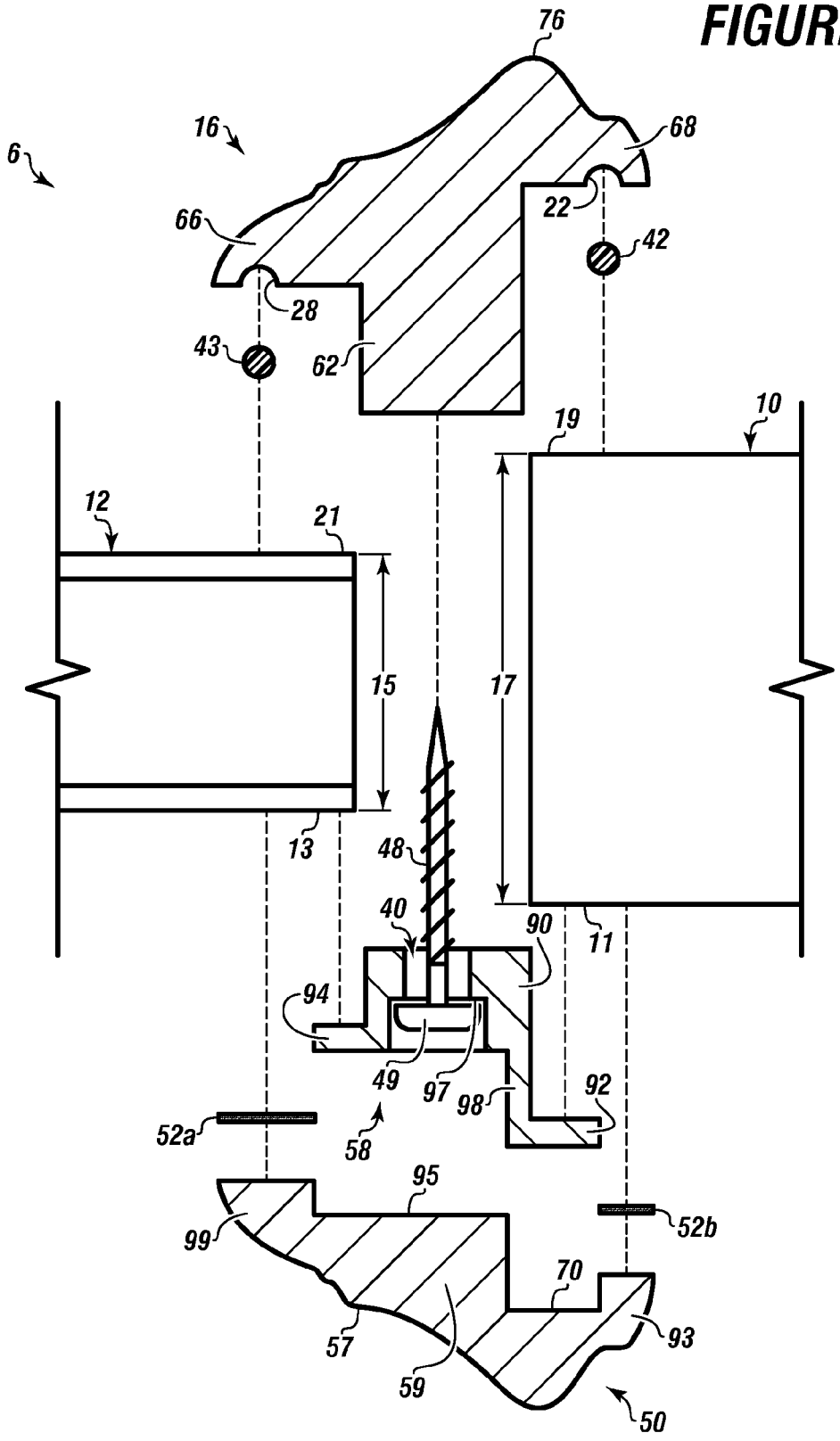
FIG. 4A depicts an exploded view of another embodiment of the dual support connector assembly usable with a door or window assembly according to the one or more embodiments of the method.
Figure 4B:
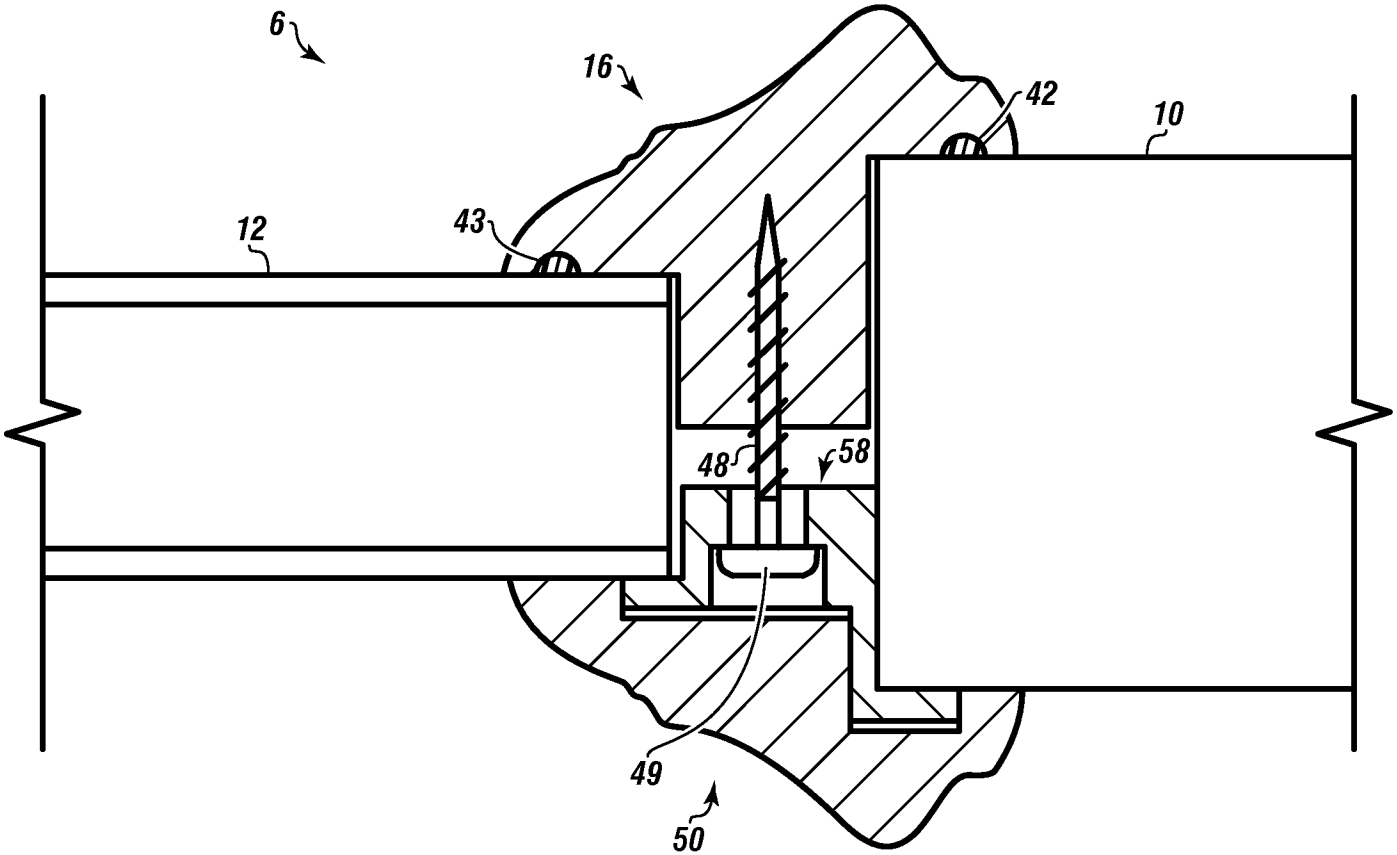
FIG. 4B is an assembled embodiment of FIG. 4A for a door or window assembly according to one or more embodiments of the method.

FIG. 4A depicts an exploded view of another embodiment of the dual support connector assembly usable with the method. FIG. 4B is an assembled embodiment of FIG. 4A usable with the method.

Referring to FIGS. 4A and 4B, the dual support connector assembly 6 can have a connector 58.

The connector 58 can include a connector body 90. The connector 58 can be aluminum, wood, alloys of metal, polyurethane, blends of polyester, polyvinyl chloride (PVC), acrylonitrile butadiene styrene copolymer, polyamide, styrene butadiene rubber copolymer, or combinations thereof.

The connector hole 40 can extend through the connector body 90. A connector stop 97 can be located in the connector hole 40. The connector stop 97 can engage a head 49 of the fastener 48, preventing the head of the fastener from passing through the connector hole.

The connector 58 can also include a connector glass panel flange 94 that is integral with the connector body 90. The connector glass panel flange 94 can extend at a right angle to the connector hole 40 and away from the connector body 90. The connector glass panel flange 94 can overlay the glass edge portion 13.

A connector structural panel flange 92 can be integral with the connector body 90. The connector structural panel flange 92 can extend at a right angle to the connector hole 40 away from the connector body 90. The connector structural panel flange 92 can overlay the panel edge portion 11.

The connector body 90 can include an integral flange support portion 98. The connector structural panel flange 92 can extend from the integral flange support portion 98.

The glass panel 12 can have glass panel thickness 15. The structural panel 10 can have a structural panel thickness 17. The glass panel thickness and the structural panel thickness can be unequal and can differ as much as from 5 percent to 90 percent in thickness from each other.

In embodiments, the interior frame 50 can include a connector groove 70 on an interior portion thereof for engaging the connector 58.

The exterior frame 16 can include the exterior frame body portion 62. The exterior frame body portion 62 can include a decorative face 76, an exterior frame door flange 68, and an exterior frame glass flange 66.

The exterior frame glass flange 66 can be configured to abut glass edge 21, and the exterior frame door flange 68 can be configured to abut structural edge 19.

The first gasket groove 22 is formed in the exterior frame door flange 68. The second gasket groove 28 is formed in the exterior frame glass flange 66.

A first seal 42 can be disposed between the structural panel 10 and the exterior frame door flange 68 in the first gasket groove 22.

A second seal 43 can be disposed between the exterior frame glass flange 66 and the glass panel 12 in the second gasket groove 28.

The interior frame 50 can be disposed over a plurality of connectors.

Interior frame 50 can have an interior frame body 59. The interior frame body 59 can include an interior frame glass flange 99, an interior frame door flange 93, and an interior frame decorative face 57. The interior frame body 59 can also include an interior frame intermediate face 95.

A first fastening means 52*a* can be disposed on the interior frame glass flange 99. The first fastening means 52*a* can connect the interior frame 50 to the glass edge portion 13. The second fastening means 52*b* can connect the interior frame door flange 93 to the panel edge portion 11 covering all of the plurality of connectors.

Figure 5:
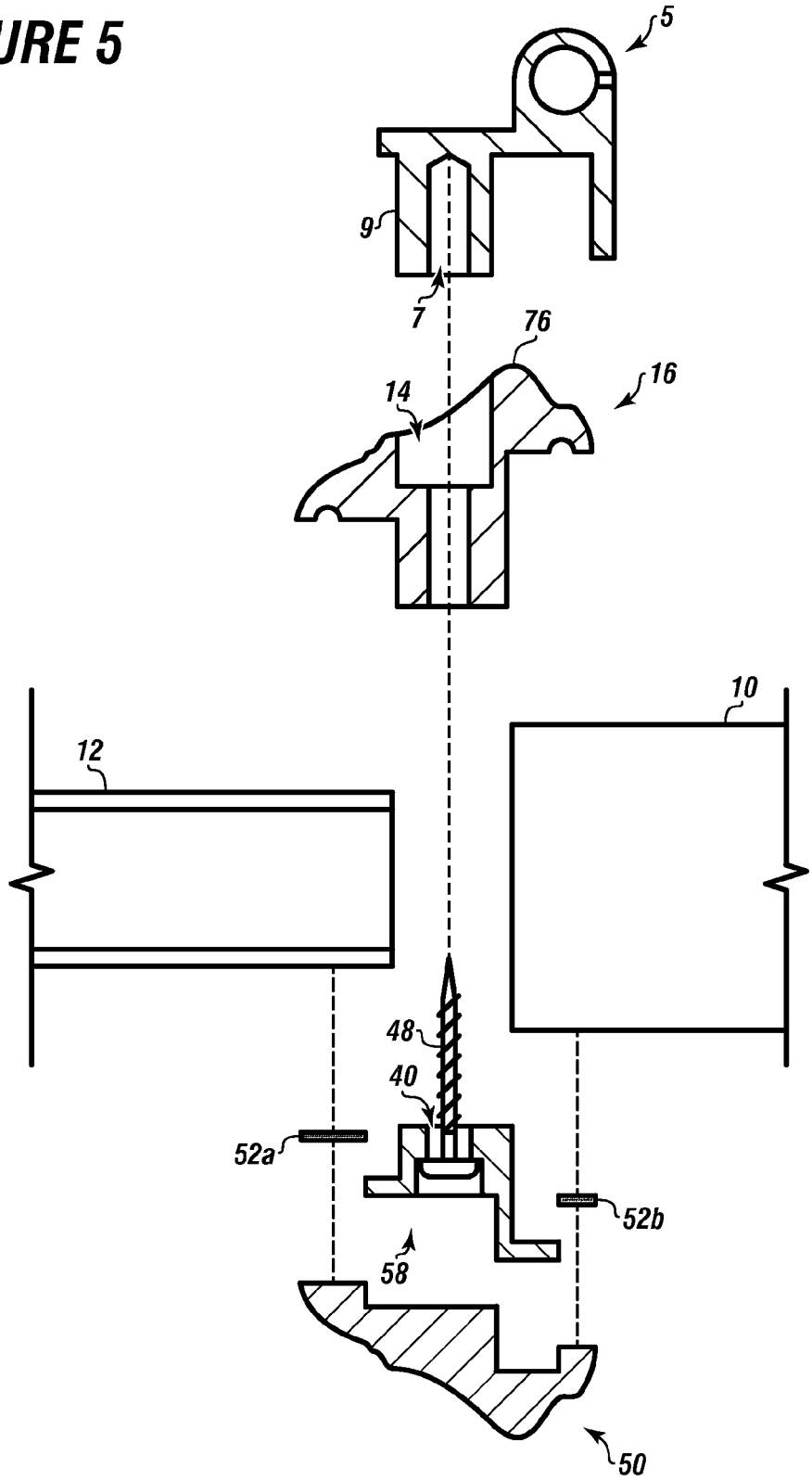
FIG. 5 depicts a detailed exploded view of a dual support connector assembly for a door or window assembly with an iron grill connector attached for security according to one or more embodiments of the method.

FIG. 5 depicts a detailed exploded view of a dual support connector assembly with an iron grill connector attachment for security usable with the method.

The fastener 48 passes through the connector 58 and into a grill recess 7 in a grill connector 5 after passing through the exterior frame 16.

The grill recess 7 can be formed in a grill extension 9. The exterior frame 16 can have a grill chamber 14 for receiving the grill extension 9. The grill chamber 14 can have an opening formed through the decorative face 76.

The interior frame 50 can connect to the glass panel 12 and the structural panel 10 simultaneously, via fastening means 52*a* and 52*b*.

The fastener 48 can extend through the connector hole 40 of connector 58 and the exterior frame 16 and the grill connector 5. The interior frame 50 can cover the connector 58.

Figure 6:
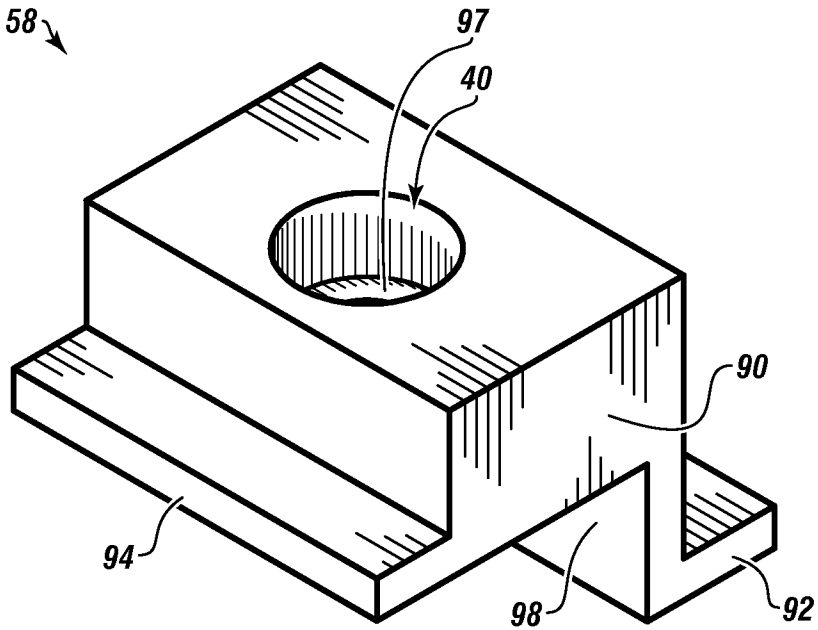
FIG. 6 shows an isometric view of a dual support connector usable to form the door assembly according to the method.

FIG. 6 shows an isometric view of a connector 58 usable with the method.

The connector 58 is shown with connector body 90 with the connector hole 40, a connector structural panel flange 92, an integral flange support portion 98, and a connector glass panel flange 94. The connector glass panel flange 94 can be integral with the connector body 90. The connector stop 97 is also depicted.

Figure 7:
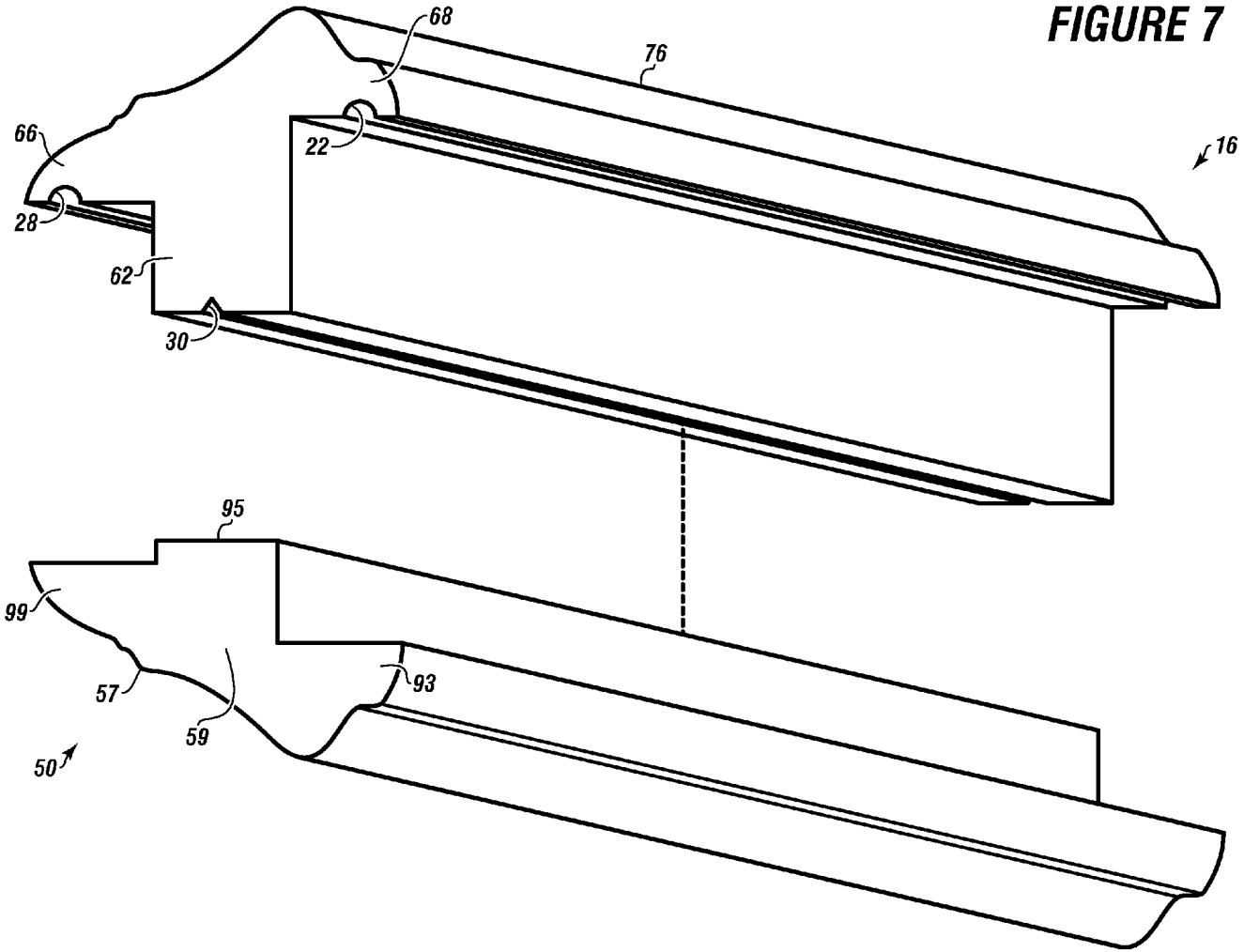
FIG. 7 depicts an isometric view of the exterior frame and the interior frame usable in the door assembly created according to the method.

FIG. 7 depicts an isometric view of the exterior frame 16 and the interior frame 50 usable with the method.

The exterior frame 16 has decorative face 76, an exterior frame body portion 62, an exterior frame door flange 68, an exterior frame glass flange 66, a first gasket groove 22, a second gasket groove 28, and an alignment groove 30.

The interior frame 50 can have an interior frame intermediate face 95, the interior frame door flange 93, the interior frame glass flange 99, the interior frame decorative face 57, and the interior frame body 59.

Figure 8:
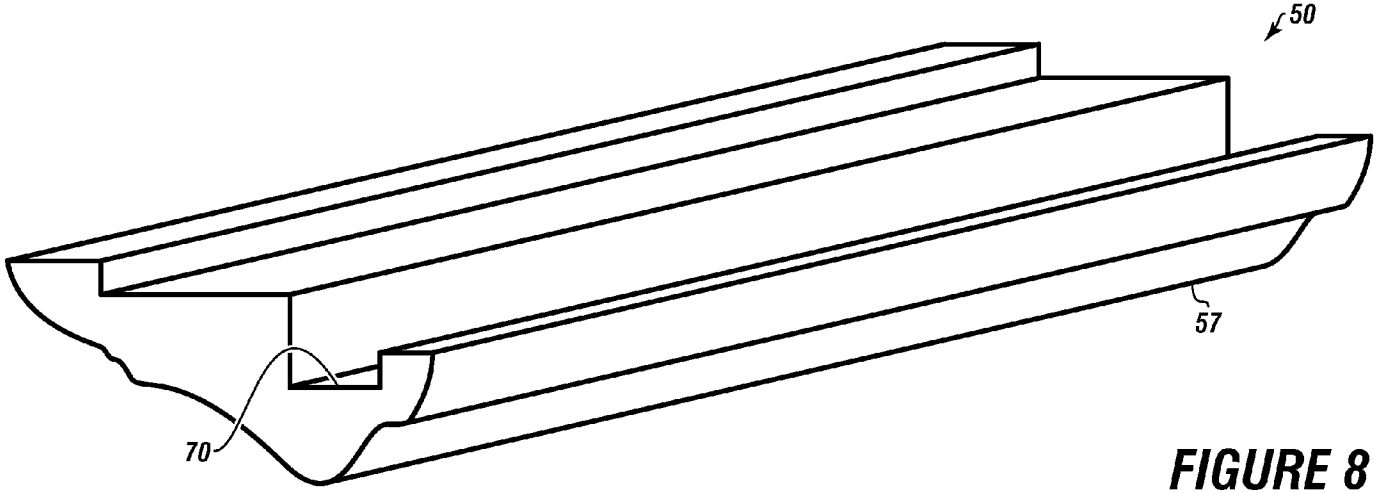
FIG. 8 depicts an isometric view of the interior frame of FIG. 9 according to the method.

FIG. 8 depicts an isometric view of another embodiment of the interior frame 50 usable with the method.

The interior frame 50 can have a connector groove 70 on an opposite side of the interior frame decorative face 57. The connector groove 70 provides a flush fit with the connector.

Figure 9:
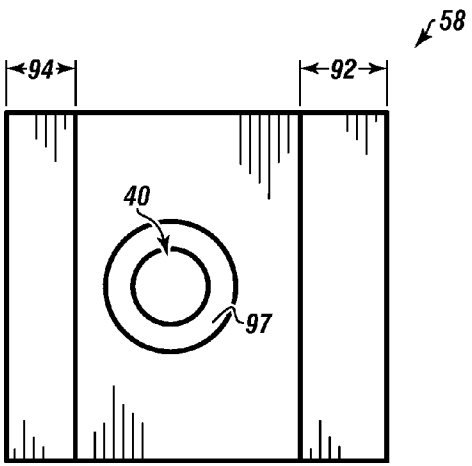
FIG. 9 depicts a top view of the dual support connector with the connector hole and a connector stop for preventing the head of a fastener from passing through the connector hole according to the method.

FIG. 9 depicts a top view of the connector 58 with the connector hole 40 and a connector stop 97 for preventing the head of a fastener from passing through the connector hole usable with the method.

The connector structural panel flange 92 is depicted wider than the connector glass panel flange 94.

FIG. 10A depicts a kit created to retrofit a glass panel into a door already installed at a field location, such as at a house, at a chemical plant, or at a retail establishment. FIG. 10B depicts an isometric view of a shipping clip and a shipping fastener used to ship the kit.

Referring to FIGS. 10A and 10B, the kit includes the interior frame 50, the exterior frame 16, the glass panel 12, a plurality of shipping clips 3*a*-3*d* for snugly holding the glass pane to the exterior frame. Also, shipping fasteners 101*a*-101*d* can secure the connectors to the exterior frame. A seal means can be preinstalled in the exterior frame 16 and the interior frame 50 to seal the glass to the frames.

A shipping fastener can be disposed through each shipping fastener hole, such as a shipping fastener hole 103*a*. Each shipping fastener has a shipping fastener hole formed in the shipping clip body 105*a*.

FIG. 11 depicts a first sequence of steps to perform the method when it is used for installing a glass panel to a door installed at a facility.

The method as step 200, involves separating an interior frame from a glass panel connected to an exterior frame with a plurality of shipping clips. The exterior frame overlays each of the four sides on an exterior side of the glass panel. A seal means is used between the glass panel and the exterior frame to provide a sealing engagement between the glass panel and the exterior frame when held together by the shipping clips.

A plurality of shipping fasteners can be used, wherein one shipping fastener connects through the body of the shipping clip to the exterior frame.

Step 201 involves installing a seal means in a groove of the exterior frame which will overlay structural portions of the door or window.

Step 202 involves placing the glass panel affixed to the exterior frame with the shipping clips still attached and the additional seal means in the groove of the exterior frame into an opening of a door.

In embodiments, the exterior frame extends beyond the opening of the door covering over portions of the structural panel on one side and presenting a decorative face on the exterior side of the door. The decorative face can be a simulated wood face. With the seal means, the exterior frame creates a seal with the structural portions of the door.

Step 203 involves placing a plurality of dual support connectors between the glass panel and the structural panel of the door. In an embodiment, the connectors can be positioned in a spaced apart relationship and can connect between either two identical thickness glass panels and door structural panels, or can connect between two dissimilar thickness glass panels and door structural panels.

Step 204 involves attaching each of the plurality of dual support connectors to the exterior panel using a fastener for each dual support connector, while the glass panel is in the door opening held by the shipping fasteners. The dual support connectors secure the glass panel to the exterior frame from an interior side of the door with the fasteners.

Step 205 involves placing fastening means around an inside surface of the interior frame which would position over the connectors.

Step 206 involves placing the interior frame with the fastening means over the edges of the opening and over the edges of the glass panel, effectively joining the interior frame to the glass panel and to the structural panel without joining with the dual support connector or with the exterior frame.

This joining method effectively causes the interior frame to cover over the plurality of dual support connectors without using an adhesive on the connectors, for easy and fast removal of the interior frame and replacement of the glass without needing glue or adhesive on individual connectors, making removal of the connectors easy and creating reusable connectors that can be recycled and are environmentally friendly, not needing to be disposable and therefore not filling landfills.

In an embodiment, the shipping clips can be removed after the dual support connectors are installed in the exterior frame.

FIG. 12 shows a factory installation method for the door assembly according to the invention.

Step 300 in a factory, involves placing the exterior frame on a surface with the decorative face on the surface and seal grooves facing away from the surface.

Step 302 involves placing seal means in each of the seal grooves.

Step 304 involves placing a door on a surface with the interior side down.

Step 306 involves installing the exterior frame with seal means over the structural portions of the door surrounding the opening, creating a seal between the exterior frame and the structural portions of the door.

Step 308 involves turning the door over with exterior frame sealed on the door and placing a glass panel with each edge of the glass panel covering over the other seal means of the exterior frame.

Step 310 involves placing a plurality of dual support connectors between the glass panel and the structural portion of the door connecting the glass flange of the connector to a side of the glass panel and the door flange of the connector to a structural portion of the door.

Step 312 involves installing a fastener through each connector body to secure the connector supporting the glass panel to the exterior frame.

Step 314 involves installing fastening means over the edges of the glass panel and the edges of the structural panel of the door on sides of the glass panel and the structural panel of the door which are not engaging the exterior frame, on the interior side of the door.

Step 316 involves placing an interior frame over the fastening means connecting removably, the interior frame to the glass panel and to the structural portions of the door covering the plurality of dual support connectors.

While these embodiments have been described with emphasis on the embodiments, it should be understood that within the scope of the appended claims, the embodiments might be practiced other than as specifically described herein.

What is claimed is:

1. A method for creating a door assembly with a door light, wherein the method comprises:

a. separating an interior frame from a glass panel connected to an exterior frame with a plurality of shipping clips wherein a seal means is disposed between the glass panel and the exterior frame for creating a sealing engagement between the glass panel and the exterior frame with the shipping clips, each of the shipping clips comprising a body;

b. installing a shipping fastener through the body of each of the shipping clips engaging the exterior frame;

c. installing an additional seal means in a groove of the exterior frame wherein the additional seal means overlays a portion of a structural panel of a door;

d. placing the glass panel affixed to the exterior frame with the shipping clips attached and the additional seal means into an opening of the door creating a seal with the structural panel of the door;

e. placing a plurality of dual support connectors between the glass panel and the structural panel of the door;

f. attaching each of the plurality of dual support connectors to the exterior panel using a fastener for each of the dual support connectors while the glass panel is in the door opening held by the shipping fasteners, securing the glass panel to the exterior frame from an interior side of the door with the fasteners and dual support connectors;

g. placing fastening means around an inside surface of the interior frame;

h. placing the interior frame with the fastening means attached over edges of the door opening and over edges of the glass panel, joining the interior frame to the glass panel and to the structural panel simultaneously, without joining the interior frame to the dual support connector and without joining the interior frame to the exterior frame.

2. The method of claim 1, wherein the glass panel comprises four sides, and wherein the exterior frame overlays each of the four sides of the glass panel.

3. The method of claim 1, wherein the exterior frame extends beyond the opening of the door covering over the portion of the structural panel on one side of the exterior frame, wherein the exterior frame comprises a decorative face on an exterior side of the door.

4. The method of claim 3, wherein the decorative face can be a simulated wood face.

5. The method of claim 1, wherein the dual support connectors are positioned in a spaced apart equidistant relationship to each other to connect the glass panel to the structural panel, and wherein the glass panel has a thickness identical to, or dissimilar to a thickness of the structural panel.

6. The method of claim 1, wherein the door is a fiberglass door, a steel door, or a composite door.

7. The method of claim 1, wherein the dual support connectors are for Craftsman style doors, and wherein each of the dual support connectors comprises:

a. a connector body;

b. a connector hole extending longitudinally through the connector body;

c. a door flange integral with the connector body and extending at a right angle to the connector hole away from a longitudinal axis of the connector body for overlaying a panel edge portion of the structural panel; and d. a glass flange integral with the connector body and extending at a fight angle to the connector hole away from the longitudinal axis of the connector body and parallel to while opposite from the door flange for overlaying a glass edge portion of the glass panel.

8. The method of claim 1, wherein the dual support connectors are for non-Craftsman style doors, and wherein each of the dual support connectors comprises:

a. a connector body;

b. a connector hole extending longitudinally through the connector body;

c. a connector glass flange integral with the connector body and extending at a fight angle to a longitudinal axis of the connector hole away from the connector body for overlaying an glass edge portion of the glass panel; and d. a connector structural panel flange integral with the connector body and extending at a fight angle to the longitudinal axis of the connector hole away from the connector body and parallel to while opposite to the connector glass flange for overlaying a panel edge portion of the structural panel while in a plane apart from a plane of the connector glass flange.

9. The method of claim 1, wherein the seal means is a member of the group consisting of: a gasket, a curable silicone sealant, a cross linked elastomer, a resin, an adhesion promoter, a natural rubber, a synthetic rubber or combinations thereof.

10. The method of claim 1, wherein each of the dual support connectors comprises a member of the group consisting of: aluminum, wood, alloys of metal, polyurethane, polyester, polyvinyl chloride (PVC), acrylonitrile butadiene styrene copolymer, polyamide, and styrene butadiene rubber copolymer, or combinations thereof.

11. The method of claim 8, further comprising using an integral flange support portion and wherein each of the dual support connectors has a connector structural panel flange extending from the integral flange support portion at an end opposite the connector body.

12. The method of claim 8, further comprising using a connector groove in the interior frame for a flush engagement with each of the dual support connectors.

* * * * *